United States Patent [19]

Wickman et al.

[11] Patent Number: 4,522,288

[45] Date of Patent: Jun. 11, 1985

[54] LUGGAGE

[75] Inventors: John A. Wickman, Swansea, Mass.; John J. Killion, III, Warren, R.I.; Charles Deschenes, North Attleboro, Mass.

[73] Assignee: American Tourister, Inc., Warren, R.I.

[21] Appl. No.: 549,552

[22] Filed: Nov. 7, 1983

[51] Int. Cl.[3] ..... A45C 5/10

[52] U.S. Cl. ..... 190/106; 190/34; 190/37; 190/115; 190/117; 190/900; 16/112; 16/126

[58] Field of Search ..... 190/34, 25, 37, 39, 190/115, 117, 106, 18 R, 900; 16/111, 112, 116 R, 119, 124, 126, 334, 335, 332, 341, 342, 382; 248/188.9, 345.1

[56] References Cited

U.S. PATENT DOCUMENTS

| | | | |
|---|---|---|---|
| 784,104 | 3/1905 | Caley | 16/342 |
| 891,607 | 6/1908 | Doront | 16/341 |
| 1,180,669 | 4/1916 | Oellrich | 16/334 |
| 2,271,266 | 1/1942 | Kost | 16/DIG. 24 |
| 2,594,027 | 4/1952 | Jakeway | 16/126 |
| 2,804,901 | 9/1957 | Lifton | 190/900 |
| 2,849,201 | 8/1958 | Schelgunov | 248/188.9 |
| 2,886,918 | 5/1959 | Bayley et al. | 248/188.9 |
| 2,913,080 | 11/1959 | Louik et al. | 16/112 |
| 2,950,793 | 8/1960 | Axtell | 190/37 |
| 3,052,497 | 9/1962 | Lohr | 16/341 |
| 3,710,901 | 1/1973 | Guard et al. | 206/284 |
| 4,114,235 | 9/1978 | Remington . | |
| 4,261.078 | 4/1981 | Edwards et al. | 190/39 |
| 4,364,150 | 12/1982 | Remington | 190/115 |
| 4,448,292 | 5/1984 | Comfort | 190/900 |
| 4,452,226 | 6/1984 | Daugirda et al. | 248/188.9 |
| 4,477,199 | 10/1984 | Manzoni | 16/332 |

FOREIGN PATENT DOCUMENTS

| | | | |
|---|---|---|---|
| 242530 | 11/1925 | United Kingdom | 16/334 |
| 348370 | 5/1931 | United Kingdom | 16/335 |
| 1186527 | 4/1970 | United Kingdom | 190/39 |

*Primary Examiner*—Joseph Man-Fu Moy
*Assistant Examiner*—David Fidei
*Attorney, Agent, or Firm*—Burns, Doane, Swecker & Mathis

[57] ABSTRACT

Luggage comprises a box and a lid hinged thereto. The box and lid are latched closed by a hasp/latch arrangement. The latch is configured to act upon the hasp to pop-open the lid when the hasp is unlatched. The lid is held open by a stay which includes a non-metallic washer sandwiched between a pair of metallic links. The washer includes a flexing shoulder which yieldably resists rotation of the links. A handle is mounted on the luggage and comprises a flexible grip which is molded onto a stiff skeleton. The latter includes anchoring holes and ribs to prevent separation of the grip from the skeleton. The handle is mounted by means of studs, the latter being secured to the lid or box by means of wedges which are pushed between flexible legs of the studs. Hinges of the lid include plastic ground-engaging pads which are joined to anchoring skirts which prevent dislodgement of the pads from the hinge.

4 Claims, 31 Drawing Figures

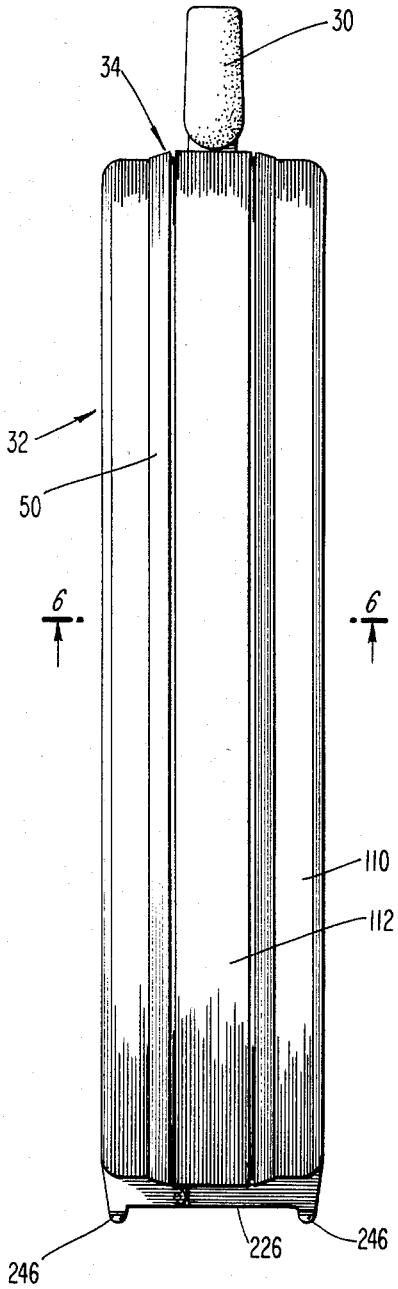
Fig. 8
Fig. 9
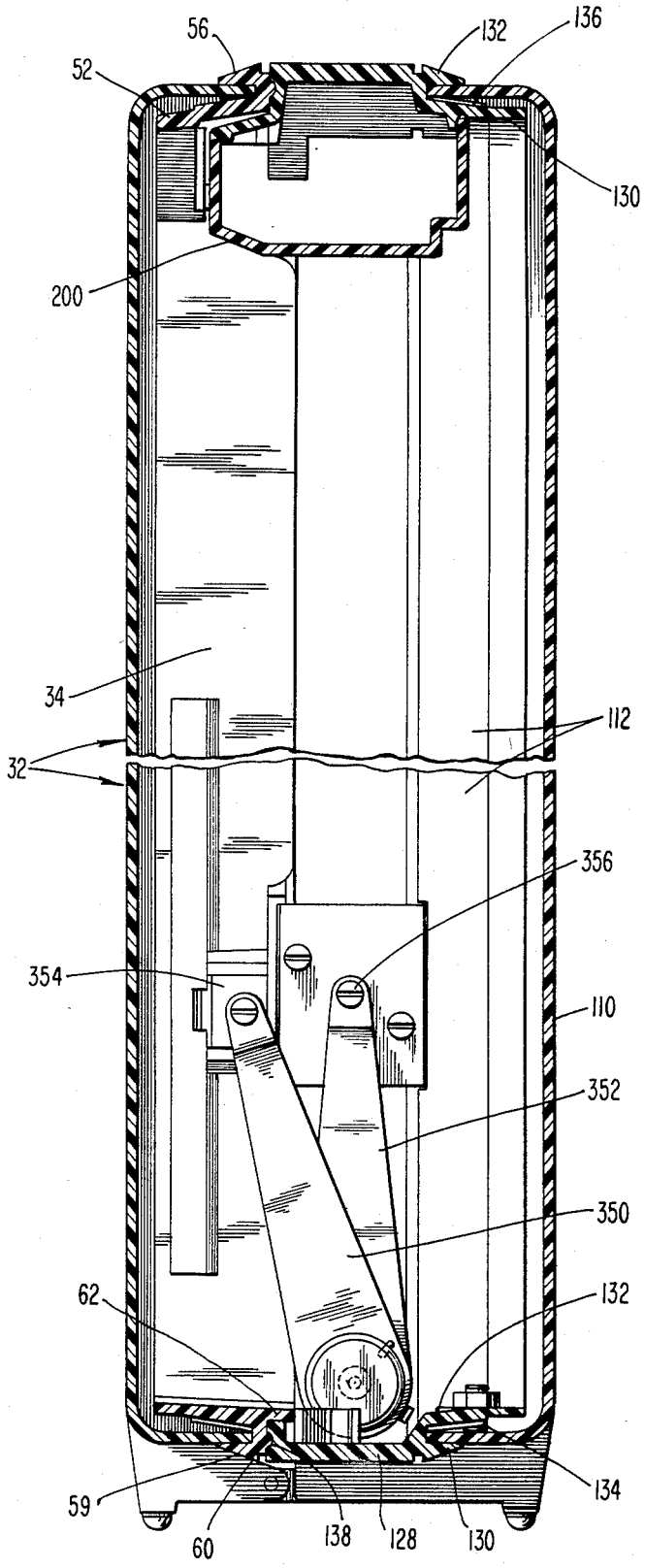

Fig. 15
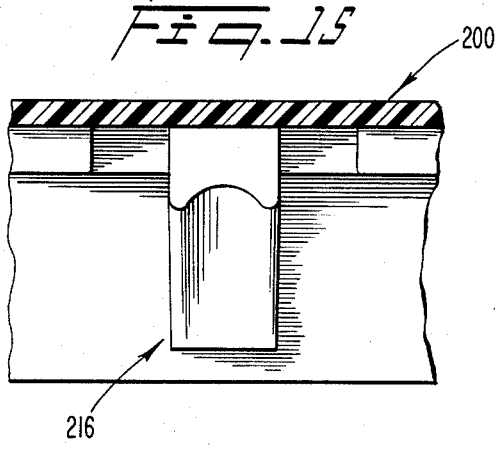
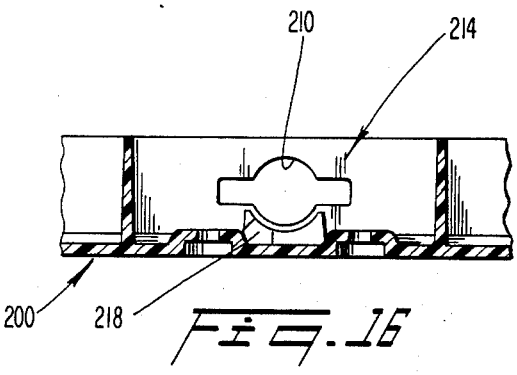
Fig. 16
Fig. 17
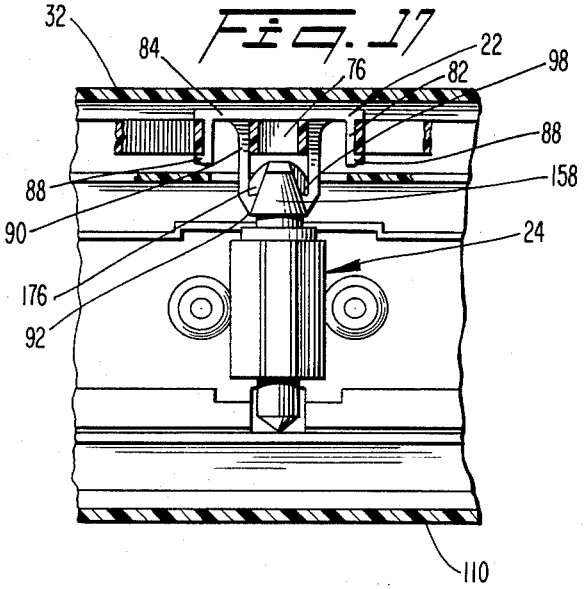
Fig. 18
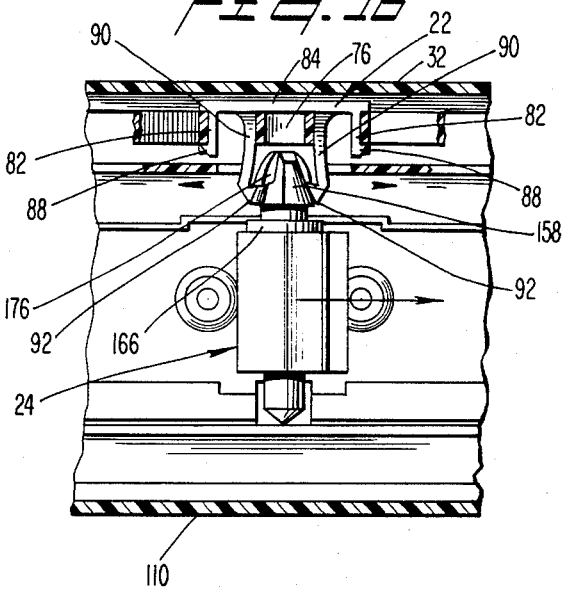
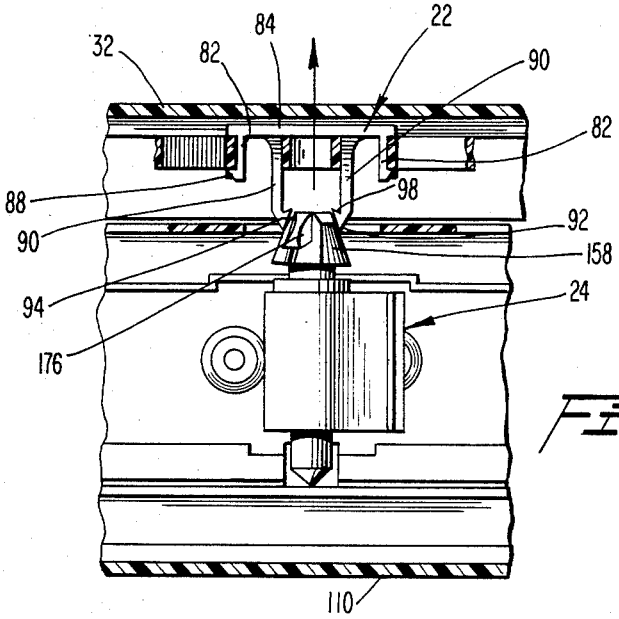
Fig. 19

Fig. 20
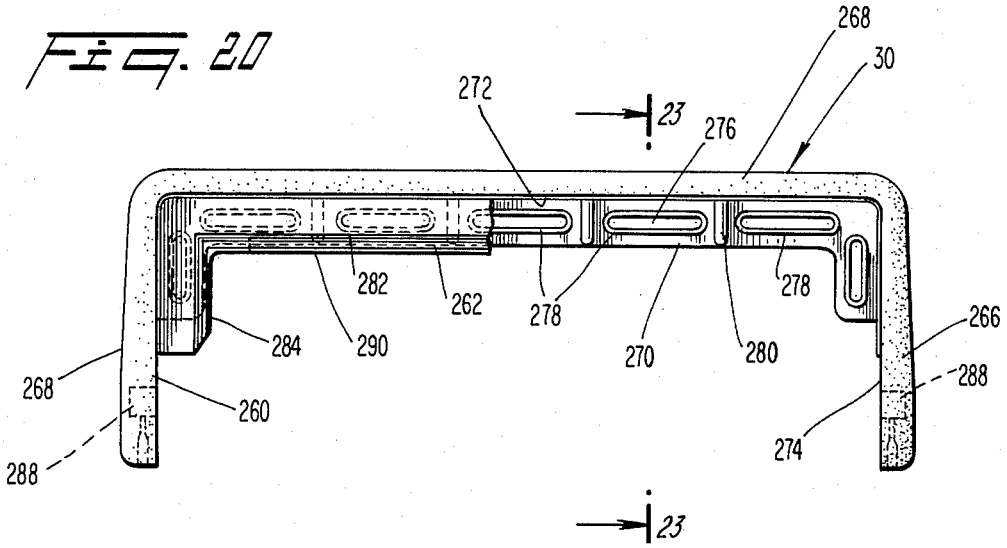
Fig. 21
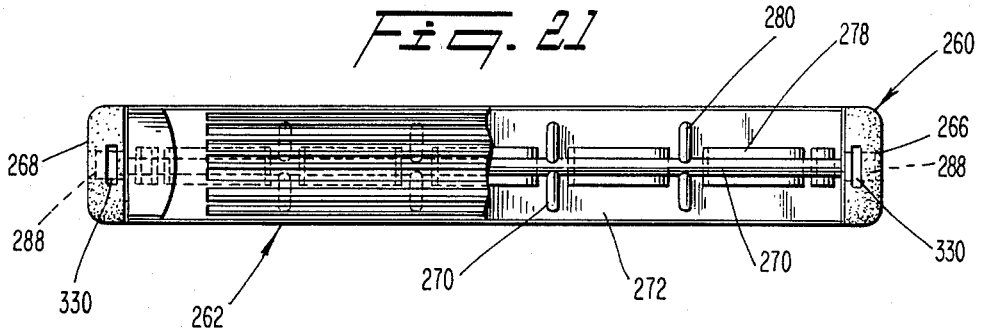
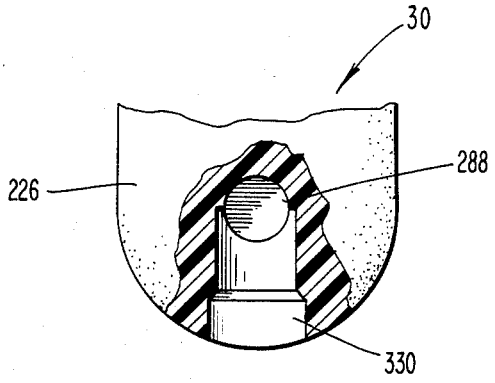
Fig. 22
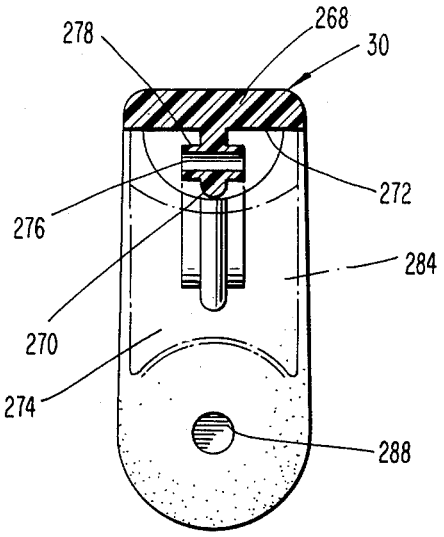
Fig. 23

Fig. 25
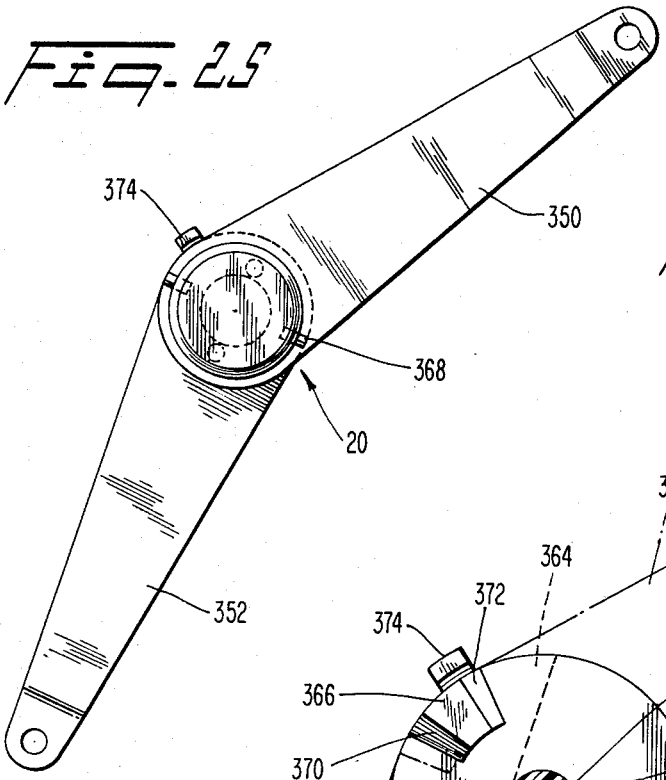
Fig. 26
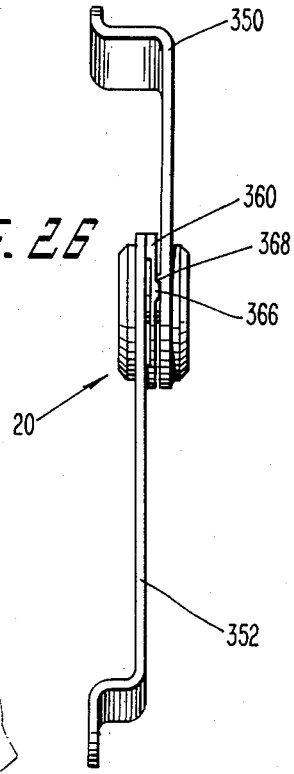
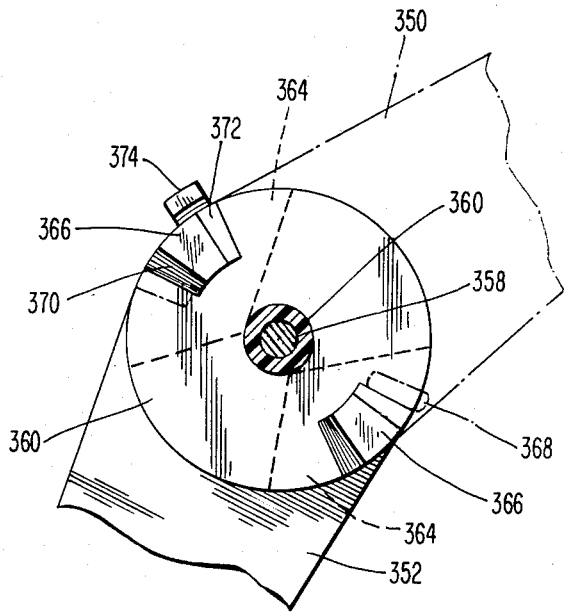
Fig. 27
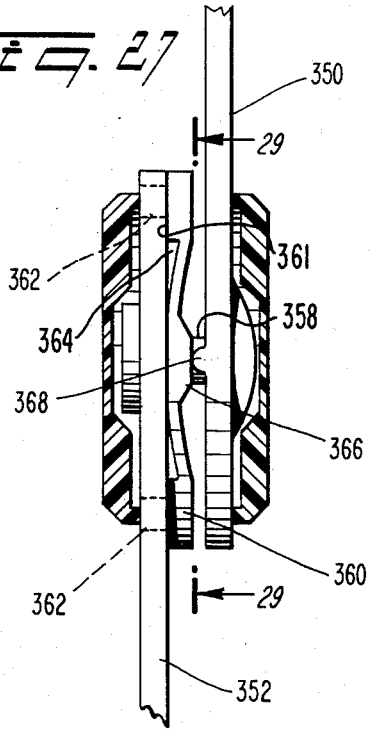
Fig. 29
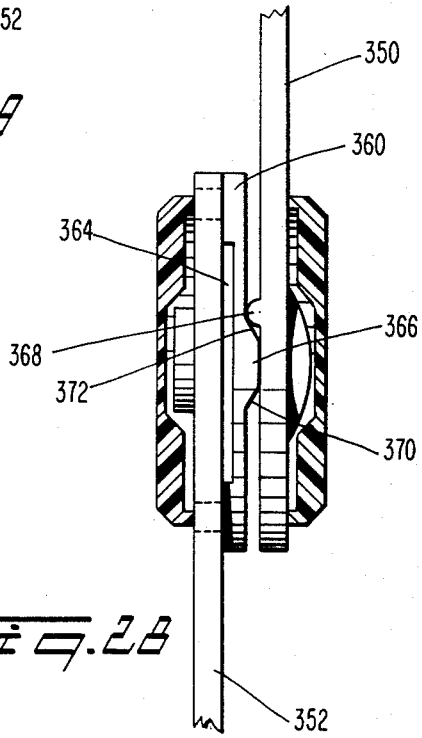
Fig. 28

LUGGAGE

BACKGROUND AND OBJECTS OF THE INVENTION

The present invention relates to luggage and luggage components and, in particular, to briefcases of the type including a box and a lid hinged thereto.

Luggage, such as a briefcase, for example, typically includes a box and a hinged lid along with one or more manually actuable latches for securing the lid closed. It is common to provide springs, separate from the latch and hasp, which serve to pop-open the lid when the hasp becomes unlatched, in order to facilitate raising of the lid. However, the provision of such separate springs and their assemblage in the luggage increases the overall cost and complexity of the luggage.

In luggage employing a hinged lid there is often provided one or more stays in the form of pivoted links which are connected between the box and lid in order to secure the lid in an open position. Such a linkage is disclosed for example in U.S. Pat. No. 4,114,235 issued on Sept. 19, 1978 to Remington, and includes a pair of links which are interconnected at adjoining ends by a rivet, the latter serving also as a pivot pin for the links. A metal washer provides frictional resistance to swiveling, and a spring biased metal ball enters a recess in one of the links to hold the links in a lid-open position. Linkages of that type, which involve metal-to-metal contact are subject to considerable friction-induced wear so that after repeated usage, the parts become loose and unable to perform suitably.

It is, therefore, an object of the present invention to minimize or obviate shortcomings of the type noted above.

Another object is to provide luggage in which a hinged lid pops-up upon being unlatched, without the use of separate spring members.

It is another object of the present invention to provide a stay for a hinged lid which eliminates metal-to-metal contact and minimizes frictional wear.

A further object of the invention is to provide novel means for mounting a handle to the luggage.

Yet another object of the invention is to provide a novel foot or base upon which the luggage rests when in a standing upright position.

SUMMARY OF THE INVENTION

These objects are achieved in accordance with the present invention which involves luggage of the type comprising a box member and a lid member hinged thereto. A hasp is mounted on one of the box and lid members and a latch is mounted on the other of the members for releasably latching the hasp. The hasp member comprises a pair of legs, the free ends of which are resiliently movable toward and away from one another. The latch comprises a post mounted for rotation about its longitudinal axis. Spreader elements are disposed on an end of the post for spreading apart the ends of the legs as the hasp is closed upon the post, and then permitting the ends of the legs to converge after passing over the spreader elements, whereupon removal of the hasps from the latch is prevented by stop faces on the spreader elements. The stop faces are configured to draw the legs together if an attempt is made to forcefully separate the hasp from the post.

A surface on the post adjacent the stop faces is convergent toward the member on which the hasp is mounted. An arm is connected to the posts to enable the posts to be rotated relative to the legs about its longitudinal axis to move the stop faces out of securing relationship with the legs and to move the surface into engagement with the ends of the legs, whereupon the ends of the legs converge and travel away from the other member along the convergent surface. Preferably, the post is configured to spread the ends of the legs apart during rotation of the posts toward a non-latching position.

Preferably, at least one stay assembly interconnects the lid and box member to retain the lid member in an open position. The stay assembly comprises first and second links interconnected at mutually adjoining ends for rotation about an axis. Another end of the first link is rotatably connected to one of the members, and another end of the second link is rotatably connected to the other of the members. The links are relatively rotatable about the aforementioned axis between lid-open and lid-closed positions. A non-metallic washer is interposed between the adjoining ends of the links. Relative rotation between the washer and the first link is prevented, while relative rotation between the washer and second links is permitted. The washer includes at least one section which is resiliently flexible away from the plane of the adjoining end of the second link. A projection is disposed on the adjoining end of the second link. A projection is disposed on the adjoining end of the second link and is directed toward the washer so as to flex the resiliently flexible section away from the plane of the second link in response to relative rotation between the lid and box members to a lid-open position until the projection travels beyond a shoulder on the resiliently flexible section enabling the latter to rebound toward said plane, whereby the shoulder resists reverse travel of the projection.

Preferably, a handle is connected to one of the lid and box members. The handle is mounted by means of a pair of studs which define a swiveling axis for the handle. Each stud includes a pair of legs having mutually facing teeth and laterally outwardly projecting feet. The legs are insertable from the exterior through an opening of the lid and box member to which the handle is connected, such that the feet are situated beyond respective shoulders of such member. A wedge is inserted from the interior into a space between the legs to expand the legs such that the feet are locked in position behind the shoulders. The wedge includes oppositely directed teeth which interconnect with the teeth on the legs to prevent separation of the wedge from the stud. The feet have angled surfaces which take-up any looseness of the stud as the latter is secured in place.

Preferably, at least one hinge element is connected through the box and lid members to define a hinge axis for the lid. The hinge element comprises first and second portions connected to respective ones of the members and are hinged together. Each first and second portion includes an internal recess and an opening in the recess. A foot member is disposed in each of the recesses. Each foot member comprises a ground support pad projecting through the opening and a hollow anchoring skirt adjoined to the pad and disposed in the recess. The thickness of the anchoring skirt increases in a direction away from the pad to prevent the skirt from passing through the opening.

THE DRAWING

The objects and advantages of the invention will become apparent from the following detailed description of a preferred embodiment thereof, in connection with the accompanying drawings, in which like numerals designate like elements and in which:

FIG. 8 is an end elevational view of the briefcase;

FIG. 9 is a sectional view taken through the briefcase along line 9—9 of FIG. 3;

FIG. 15 is a sectional view taken along line 15—15 of FIG. 7;

FIG. 16 is a cross-sectional view taken along line 16—16 in FIG. 7;

FIG. 17 is a front view of a latching mandrel, depicting the hasp being latched thereto;

FIG. 18 is a view similar to FIG. 17, after the mandrel has been rotated sufficiently to bring the legs of the hasp out of locking relationship with the ears of the mandrel;

FIG. 19 is a view similar to FIG. 18, after the legs of the hasp have rebounded and thereby slide upwardly a surface of the mandrel;

FIG. 20 is a side elevational view of a handle of the briefcase, with a portion of the soft gripping element removed to expose a frame section of a stiff part of the handle;

FIG. 21 is a rear end view of the handle of FIG. 20;

FIG. 22 is a fragmentary view of a leg portion of the stiff part of the handle, with a portion thereof broken away to expose a mounting hole and slot which receive mounting elements for the handle;

FIG. 23 is a cross-sectional view taken along line 23—23 of FIG. 20;

FIG. 25 is a side elevational view of a stay assembly which maintains the lid in an open position;

FIG. 26 is an end elevational view of the stay assembly depicted in FIG. 25;

FIG. 27 is an enlarged view of the pivot portion of the stay assembly, as viewed from one end, with the resilient washer of the stay assembly being depicted in a flexed condition as the links are being moved toward either a lid-open or lid-closed position;

FIG. 28 is a view similar to FIG. 27, after the stay links have arrived in a lid-open or lid-closed position, enabling the washer to rebound to its rest position;

FIG. 29 is a cross-sectional view taken along line 29—29 of FIG. 27;

DETAILED DESCRIPTION OF A PREFERRED EMBODIMENT OF THE INVENTION

Figure 1:
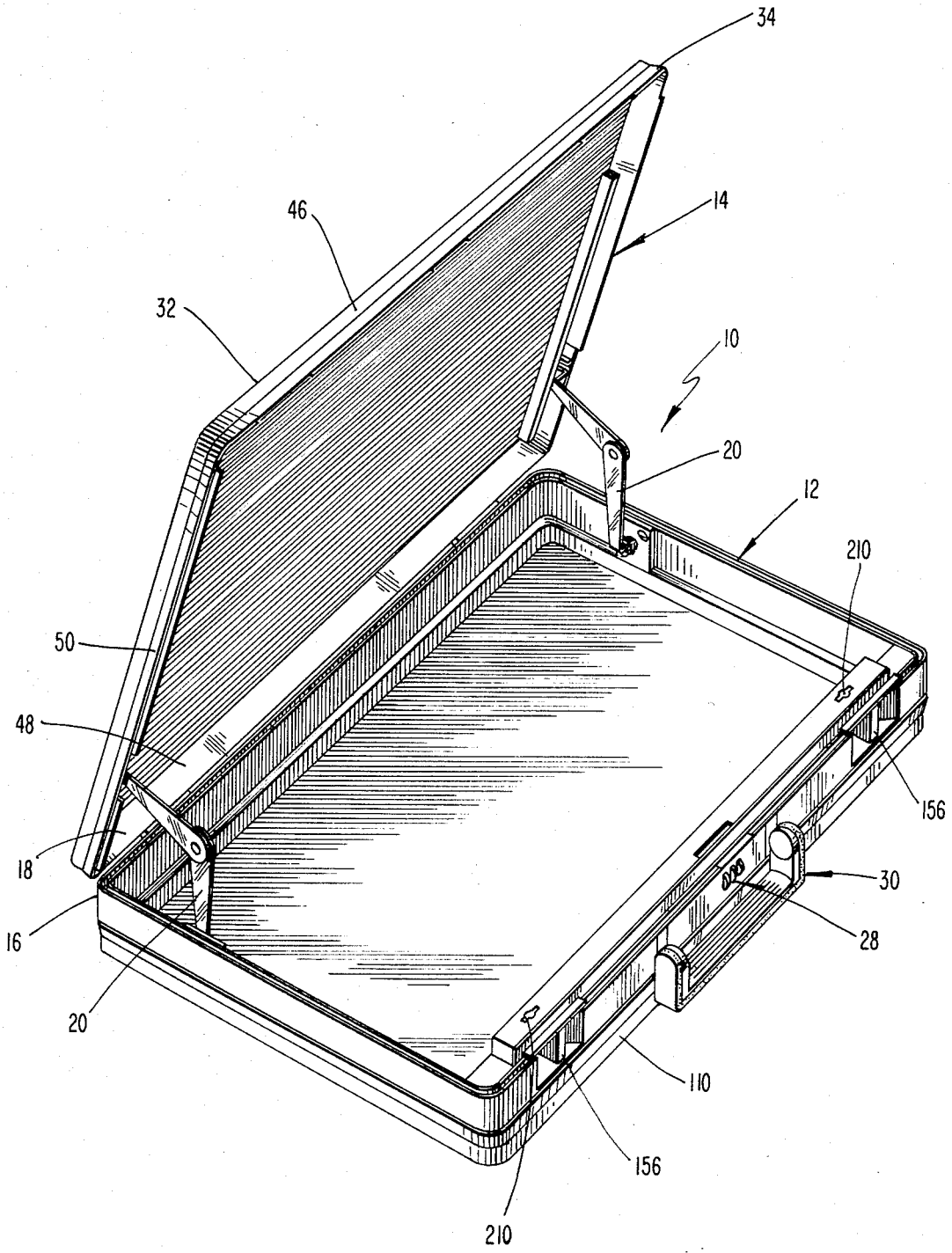
FIG. 1 is a perspective view of a briefcase type of luggage according to the present invention, with a hinged lid member being held in a lid-open position.

The term "luggage" as employed hereinafter is intended to refer generally to containers of the type having box and lid portions. The preferred embodiment of the invention is to be described in connection with a briefcase-type of luggage.

A briefcase 10 in accordance with the present invention comprises a box section 12 and a lid section 14 which are hinged together at their rear edges 16, 18. The lid can thus be swung open and closed and is releasably held in the open position by means of a pair of stays 20 which interconnect the box and lid 12, 14.

Figure 7:
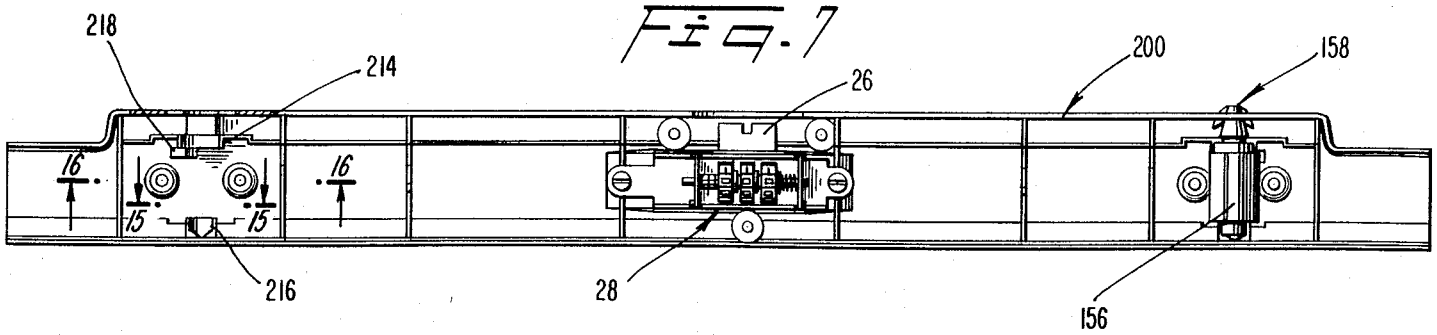
FIG. 7 is a front elevational view of a cover member with the latter being detached from the box frame and viewed in a direction from the front of the briefcase, with only one of the mandrels being mounted therein.

The lid 14 includes a pair of closure hasps 22 (FIGS. 10, 17) which are releasably securable to a pair of latching mechanisms 24 on the box 12. The lid 14 also carries a main locking hasp (not shown) which is releasably securable to a locking bolt 26 (FIG. 7) of a combination lock 28 carried by the box 12. A manual gripping handle 30 is rotatably coupled to the box and is rotatable between raised and lowered positions.

Figure 4:
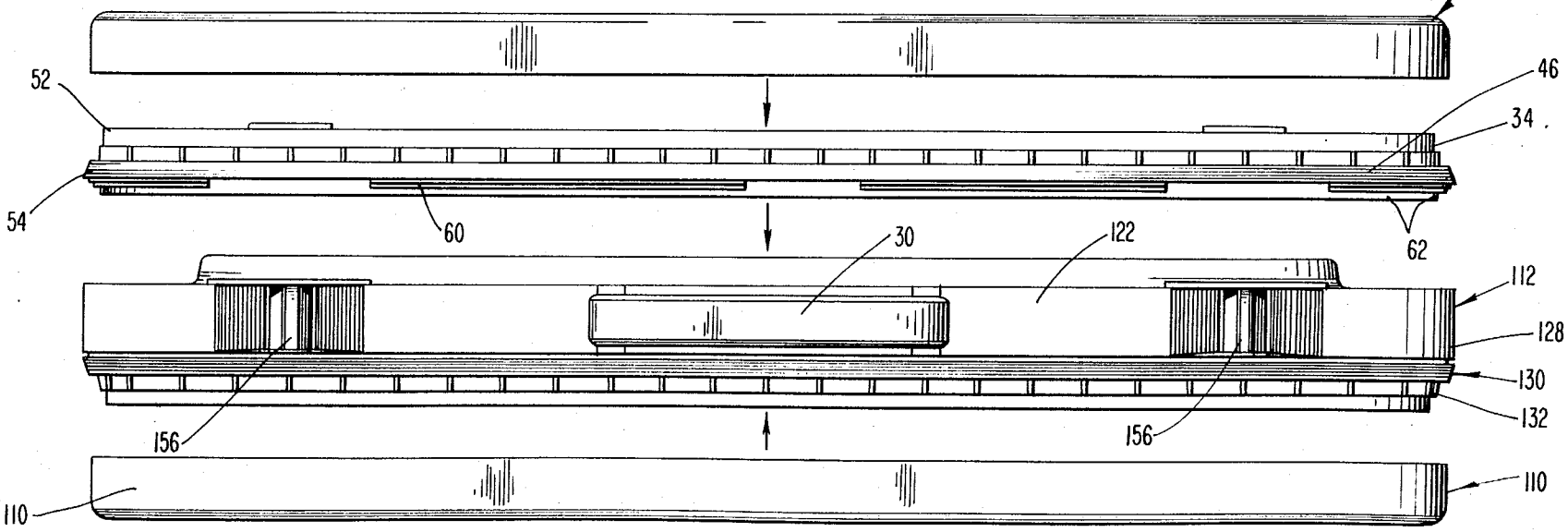
FIG. 4 is a front exploded view of the briefcase depicting the shells of the lid and box members being separated from the frames of such members.
Figure 10:
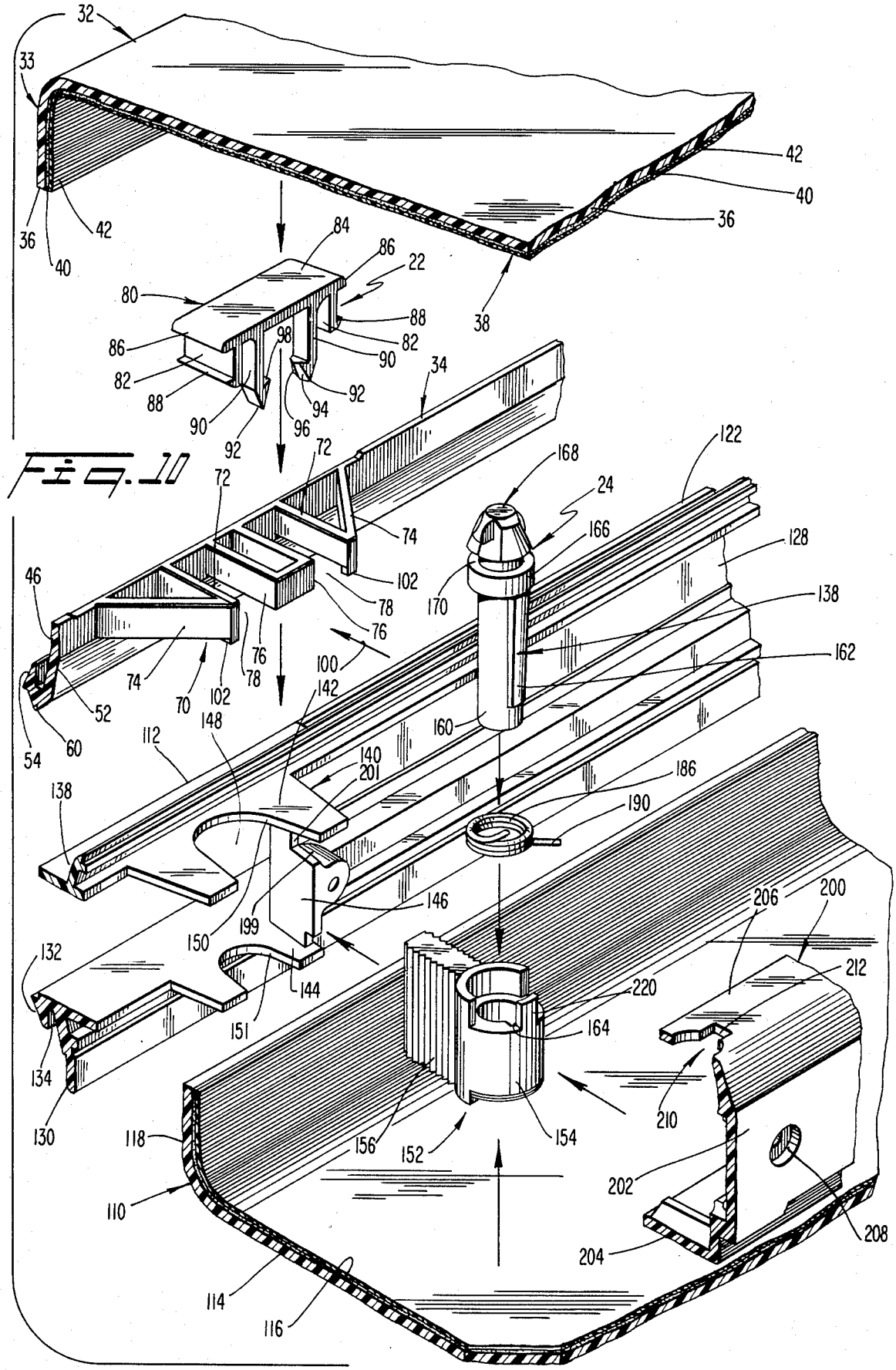
FIG. 10 is a perspective, exploded, fragmentary view of a portion of the briefcase.
Figure 11:
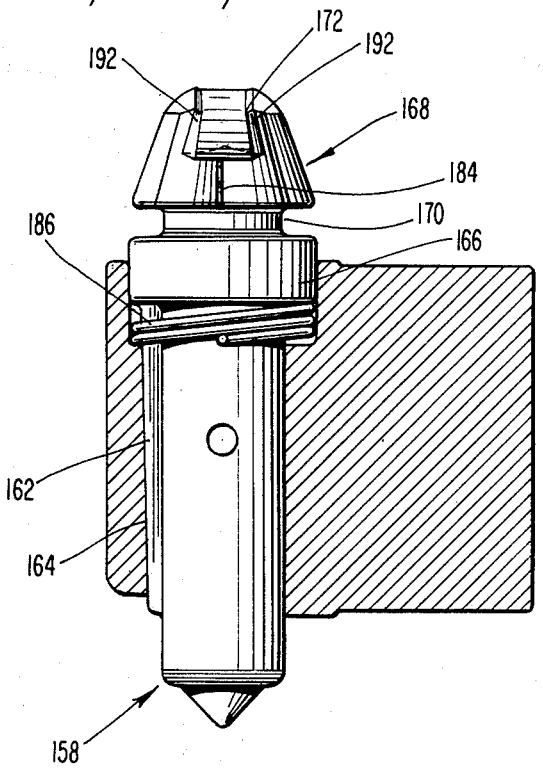
FIG. 11 is an elevational view of a mandrel according to the present invention.
Figure 12:
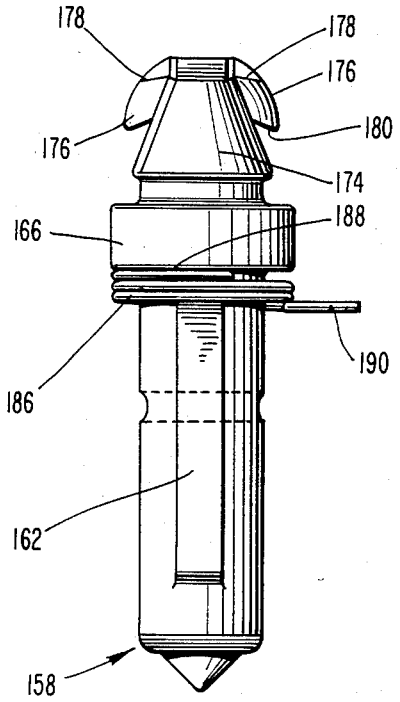
FIG. 12 is a view of the mandrel in a direction oriented 90 degrees relative to the direction depicted in FIG. 11.
Figure 13:
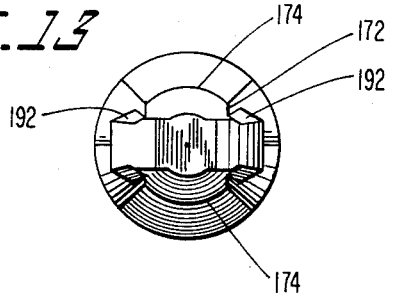
FIG. 13 is a plan view of the mandrel.

The lid section 14 comprises a shell 32 (FIG. 4) and frame 34 which are bonded together. The shell 32 is formed of a hard panel 36 to which is bonded a soft laminate 38 (FIG. 10). The hard panel 36 is preferably formed of a stiff plastic, such as ABS (acrylonitrile-butadiene-styrene copolymer). The soft laminate comprises a layer 40 of plastic foam, such as SBR (styrene-butadiene rubber), urethane or polyethylene for example, to which has been bonded a soft plastic film 42 such as vinyl. A suitable high-temperature resistant adhesive is employed to bond the soft plastic film to the foam, and to bond the foam to the hard plastic sheet.

The composite member, comprising the hard plastic sheet 36, the plastic foam 40, and the soft plastic film 42 is provided in a planar configuration, and is subjected to a conventional vacuum forming process in which the member is thermo-formed to a concave shape, i.e., the edges are bent at a right angle to form a lateral rim 33. The member can be deformed in either direction such that the soft laminate constitutes an external overlay or an internal liner.

The lid frame 34 is of one-piece molded stiff plastic construction having a rectangular ring-shaped configuration. The plastic may comprise a polymer such as polycarbonate for example. The frame 34 includes a front side 46 and a rear side 48 interconnected by parallel lateral sides 50. The frame 34 also includes a rectangular flange 52 and an offset rim 54 extending around an outer end of the flange and spaced exteriorly therefrom to form a groove 56 extending completely around the frame 34. The groove opens in a direction perpendicular to the plane of the frame (i.e., toward the box 12).

A convex, generally V-shaped ridge 60 (FIG. 9) extends along an outer lower end edge of the frame 34 (FIG. 10). A guide wall 62 (FIGS. 4, 9) projects outwardly beyond the outer end edge of the lateral sides of the frame.

The groove 56 of the frame 34 is dimensioned to receive the bent rim 33 of the lid shell 32. The frame 34 is bonded to the shell 32 by means of a conventional adhesive, preferably a radio frequency excitable bonding agent such as that marketed by Emabond Inc., an affiliate of W. R. Grace, 49 Walnut St., Norwood, N.J.

Figure 6:
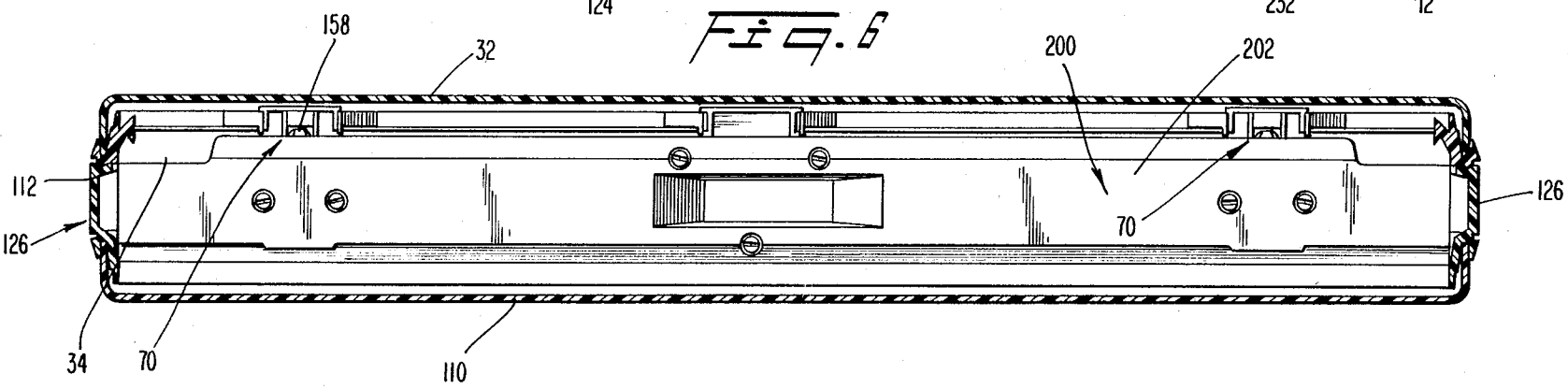
FIG. 6 is a longitudinal sectional view taken through the briefcase along line 6—6 of FIG. 8.

The frame further includes two pairs of brackets 70 (FIGS. 6, 10) molded integrally with, and projecting interiorly from, the front side 46 of the flange. Each of the brackets includes a pair of first walls 72 which are braced by diagonal struts 74, and a pair of second walls 76 disposed intermediate the first walls and forming a pair of slots 78 therewith.

Each of the afore-mentioned hasps 22 comprises a one-piece molded plastic element which includes a U-shaped section 80 defined by a pair of parallel arms 82 interconnected by a back wall 84. The latter projects beyond the arms 82 to form a pair of ledges 86 at the bases of the arms. Each of the arms 82 terminates in a lateral shoulder 88, the shoulders extending in mutually opposite directions. Disposed between the arms 82 are a pair of legs 90 which extend from the back wall 84 and parallel to the arms 82. Each of the legs 90 is anchored to the back wall and includes a foot 92 disposed at its free end. The legs thus form cantilevers whereby the free ends of the legs are resiliently flexible toward and away from one another to a limited extent. Each foot 92 includes a cam follower surface 94 which is convex and forms a peak 96 at the center. Also, the cam follower surfaces 94 are inclined so as to be mutually divergent in a direction toward the box 12 of the briefcase. Each foot 92 forms a lateral stop shoulder 98 which overlies the cam follower surface 94.

The hasp 22 is releasably insertable into its respective bracket 70 by pushing the hasp into the bracket in the direction indicated by the arrow 100 in FIG. 10. This step is facilitated by pinching the legs 90 toward one another. The space between each lodge 86 of the hasp and its associated shoulder 88 serves as a guide track for one of the bracket walls 72. After the ledge 86 passes beyond a stop post 102 of the wall 72, the ledge snaps into a locked position therebehind. Thus, each hasp is confined against removal from the bracket by means of the shoulders 88, the ledges 86 and the stop posts 102.

The box portion of the briefcase includes a shell 110 and a frame 112 each formed preferably of plastic. As noted earlier, the box shell 110 can be identical in size and shape to the lid shell 32 and formed in an identical manner, i.e., of a hard plastic sheet 114 having a soft plastic laminate 116 thereon and shaped by a vacuum forming step to form a bent rim 118.

Figure 2:
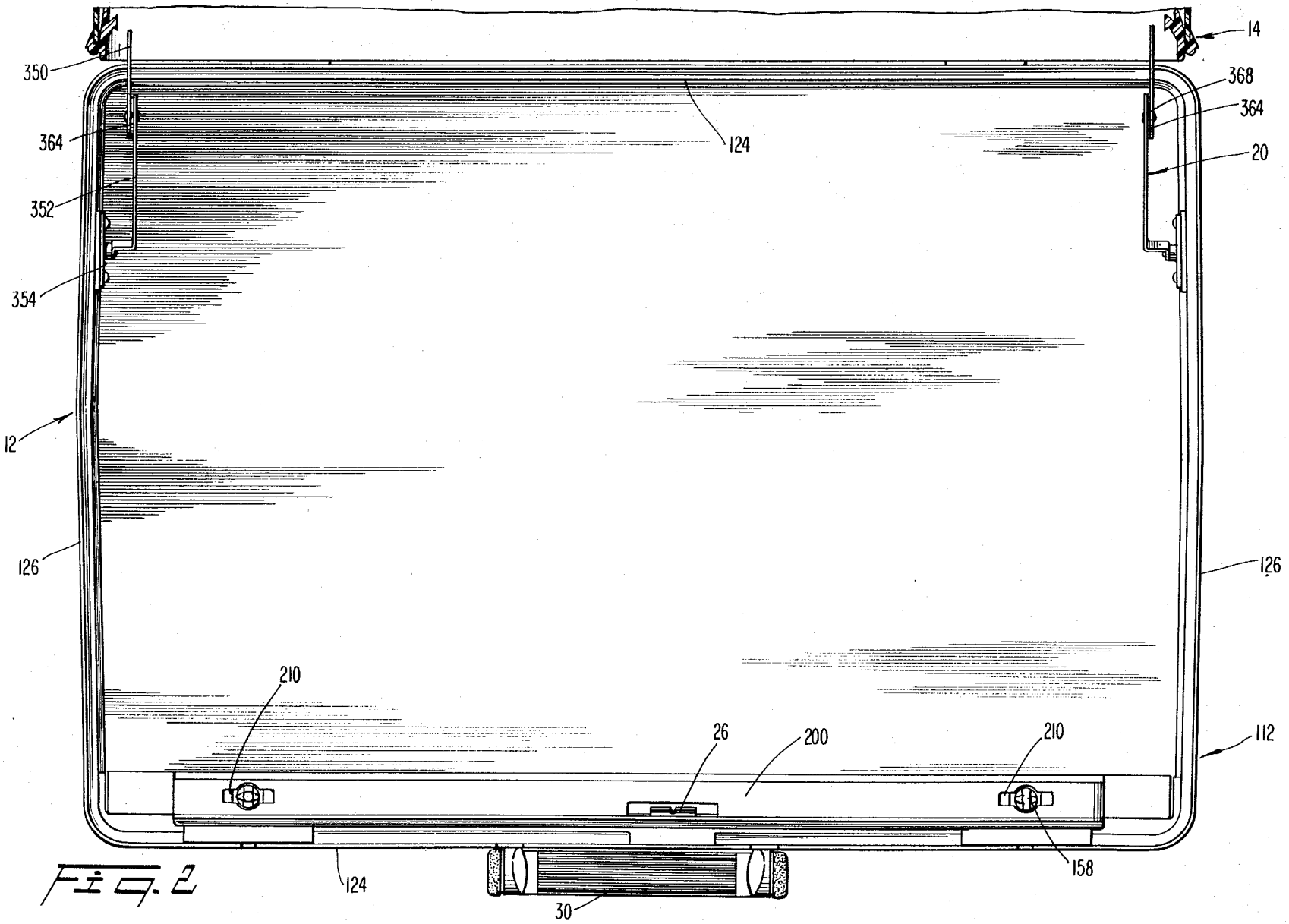
FIG. 2 is a plan view of a box member of the briefcase, with the lid held in a raised position.
Figure 3:
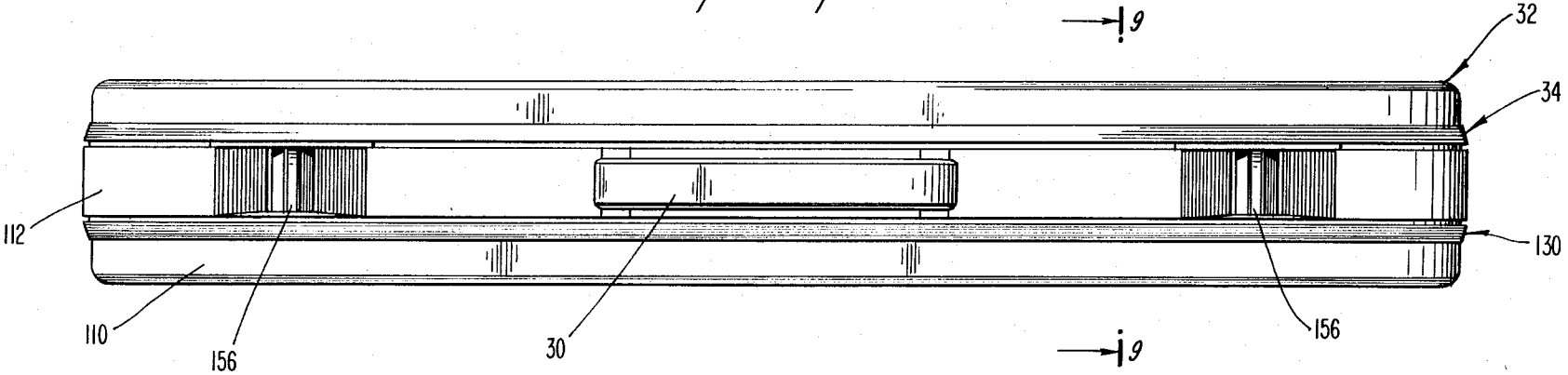
FIG. 3 is a front view of the briefcase, with the lid closed.

The box frame 112 includes a one-piece molded base 120 of rectangular ring-shape, including a front side 122, rear side 124, and a pair of parallel lateral sides 126 (FIG. 2). The box frame base includes a main wall 128 (FIG. 4), a flange 130 depending from the wall, and a rim 132 extending around the flange and offset therefrom to form therewith a groove 134 (FIG. 9) which extends completely around the frame and opens in a direction perpendicular to the plane of the frame.

A concave, generally V-shaped recesses 138 extends along the outer edge of the main wall 128 and is configured in complementary fashion to the afore-described convex ridge 60 (FIGS. 4, 10) which projects from the lid frame. Thus, the ridge 60 enters the recess 138 when the lid is closed, to register the lid 14 properly with the box 12.

Projecting interiorly from an inside surface of the front side 122 of the box frame 112 are pairs of toggle-mounting brackets 140 (FIG. 10). The brackets preferably comprise an integrally molded part of the box frame. Each bracket includes top and bottom walls 142, 144 and opposing side walls 146 which border an opening 148 in the main wall 128. The top and bottom walls 142, 144 form aligned semi-circular slots 150, 151 which are adapted to receive a toggle arm 152. The toggle arm 152 includes a sleeve 154, an actuator lug 156 projecting from the sleeve and a post or mandrel 158 mounted within the sleeve. The sleeve 154, lug 156 and mandrel 158 are preferably molded in one-piece of 45% glass-filed PET. The mandrel 158 is mounted with a press-fit within the sleeve. A cylindrical stem 160 of the mandrel has a rib or key 162 extending longitudinally thereon which fits within a longitudinal slot 164 in the sleeve to prevent relative rotation between the mandrel and sleeve. A collar 166 of larger diameter than the stem 160 is disposed at one end of the key, and a latching head 168 is disposed at an outer end of the stem 160 and adjacent the collar 166. The latching head 168 is spaced axially from the collar to define therewith an annular groove 170. The configuration of the latching head 168 is generally conical, with two opposite sides 172 thereof being somewhat longer than the other two opposite sides 174.

A pair of diametrically opposed latching ears 176 project laterally from the longer sides. Those ears form a pair of camming surfaces 178 which diverge longitudinally in an inward direction (i.e., toward the box shell 110). Each ear 176 forms a lateral stop surface 180 at an inner end thereof about midway along the height of the longer sides 172.

The latching ears 176 are oriented so as to be aligned with the legs 90 of a respective hasp 22 so that upon closing of the lid, the cam follower surfaces 94 of the legs are spread apart by the camming surfaces 178 until passing beyond the latter, whereupon the legs rebound (spring-back) toward each other to position the stop shoulders 98 of the hasp 22 behind respective ones of the stop surfaces 180 of the latching ears (FIG. 17). Such a relationship of the stop shoulders and stop ears prevents the lid from being opened.

The stop surfaces 180 are inclined upwardly and inwardly and receive the correspondingly inclined stop shoulders 98 of the legs 90 (FIG. 17). As a result, if upward force is applied to the lid and hasp when the lid is in a closed condition, the engagement between the stop surfaces 180 and the stop shoulders 98 will tend to converge the legs 90 of the hasp, thereby enhancing the locking action between the hasp and mandrel.

Each longer side 172 of the latching head constitutes a contact surface against which a respective cam follower surface 94 bears when the briefcase is closed. The contact surface 172 is of concave configuration which is complementary to the convex configuration of the cam follower surfaces 94. Thus, the contact surface 172 forms a valley 184 beneath a respective ear 176 to receive the peak 96 of the respective cam follower surface.

A helical torsion spring 186 surrounds the stem 160 at a location just beneath the collar 166. One end 188 of the spring bears against the key 162, while the other end 190 projects beyond the sleeve through a notch therein. The spring 186 biases the mandrel toward positions in which the ears 176 are aligned with the cam follower surfaces 94, as will be explained later.

The lug 156 of the toggle arm constitutes an actuator which is accessible from the exterior of the briefcase and enables the mandrel to be manually rotated about its own longitudinal axis. In so doing, the concave contact surfaces 172 move relative to the peaks 96 of the cam follower surfaces 94 to mutually separate (spread-apart) the legs 90 of the hasp until the cam follower surfaces 94 disengage from the ears, i.e., pass from beneath the ears in a circumferential direction. At this point, the legs engage a portion of the contact surface which is conical, e.g., convergent toward the lid. Since there is no obstruction to the tendency of the spread-apart legs 90 to spring-back toward one another, the cam follower surfaces 94 travel longitudinally upwardly along the contact surfaces 172. That is, as the legs 90 spring-back, the cam follower surfaces 94 travel upwardly along the contact surfaces 172 since the latter converge in an upward direction and since the ears 176 are no longer disposed to prevent such travel. Accordingly, the lid tends to pop-open to a slight extent, in response to the hasps being unlatched, thereby eliminating the need for separate springs to achieve this function.

The sides 192 of the ears 176 are beveled, i.e., they tend to converge in a direction away from the axis of the mandrel, to minimize any obstruction to the upward travel of the legs of the hasp.

The concave-convex relationship of the contact surface 172 and cam follower surface 94 tends to retain the legs 90 in a latching position since the cam follower surface 94 tends to remain in the valley 184. As noted above, the concave nature of the contact surface 172 causes the legs 90 to spread apart during the unlatching process, whereby the inherent rebounding tendency of the legs serves as a self-opening measure.

The sleeve 154 is dimensioned to fit between the slots 150, 151 of the box frame 112, such that the collar 166 is received in the upper slot 150 and the stem 160 is received in the lower slot 151. The outer diameter of each sleeve 154 is larger than the width of the lower slot 151, so that the sleeve sits upon the lower wall 144. The projecting end 190 of the spring 186 fits into a notch 199 in one of the side walls.

Extending over the brackets is a cover 200, preferably molded of a polymer plastic such as polycarbonate (see FIGS. 6, 7, 10 and 15–19). The cover is generally U-shaped and includes a back wall 202 extending parallel to the front wall 122 of the box frame 112, and inner and outer lateral walls 204, 206 extending to that front wall. The cover 20 is affixed to the front wall 112 by suitable fasteners, such as screws, which fit into suitably mounted holes 208 on opposite sides of each bracket 140.

The outer lateral wall 206 includes a pair of openings 210 (FIG. 1) aligned with respective ones of the mandrels 158. Each opening 210 is circular with lateral notches 212 which receive the legs 90 of the hasp 22. The back wall 202 of the cover 200 includes a pair of arcuate pockets 214, 216 (FIG. 7) beneath each hole, which pockets receive the collar and stem 166, 160, respectively, of a mandrel 158 in order to support the mandrel/sleeve unit 152, 158 for rotation about the longitudinal axis of the mandrel. That is, the upper pocket 214 fits into and closes-off the end of the upper slot 150, and the lower pocket 216 fits into and closes-off the end of the lower slot 151 in order to confine the toggle arm 152. Beneath the upper or outer pocket 214 is positioned a stop shoulder 218 which is adapted to be engaged by a stop lug 220 of the sleeve when the sleeve is attempted to be rotated in a given direction. Thus, the toggle arm 152 is constrained to rotate in the opposite direction only. As the toggle arm rotates in such opposite direction, the projecting end 190 of the spring bears immovably against the rear edge 201 of the notch, whereby the spring becomes energized (deformed) and yieldably resists rotation, i.e., it biases the toggle arm back toward its rest position.

To close the lid 14, the lid is lowered and the legs 90 of the hasp 22 enter the notches 212 in the cover 200. The legs 90 are flexed apart as the cam follower surfaces 94 thereof slide along the latching ears 176. Thereafter, the ends of the legs snap back (rebound) beneath the stop surfaces 180 of the latch ears to secure the lid to the box.

By thereafter rotating the toggle arms 152, the latching ears are displaced out of overlying relationship with the stop shoulders 98 of the legs 90, whereupon the lid is unlatched and popped-open as explained earlier. The springs 186 then return the toggle arms to their rest positions.

The combination lock 28 is mounted centrally on the cover 200. This lock mechanism can be of any suitable design, such as that described in a commonly assigned copending application Ser. No. 06/372,232 of Louis Zampini, Jr., filed Apr. 28, 1982.

Figure 5:
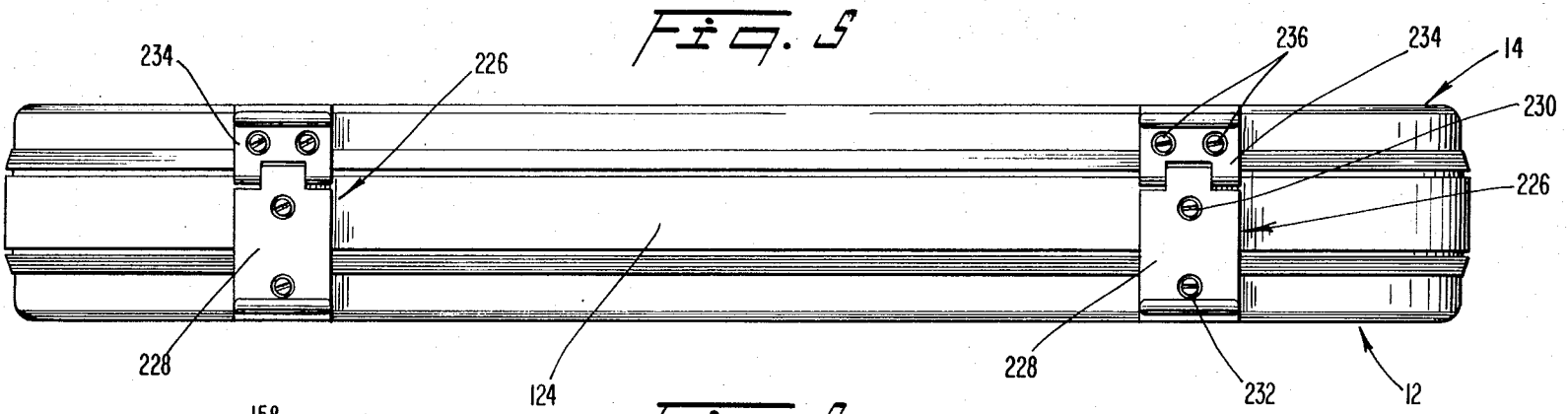
FIG. 5 is a rear view of the briefcase with the lid closed.
Figure 14:
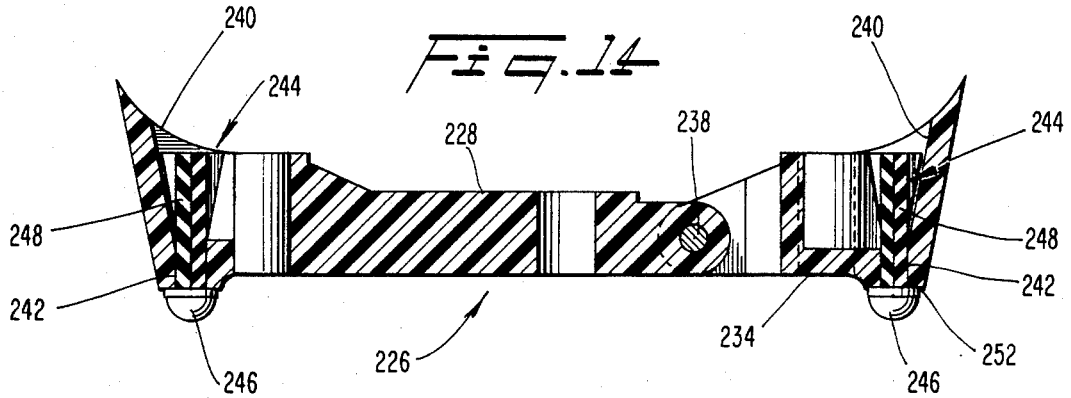
FIG. 14 is a cross-sectional view taken through a hinge element of the briefcase.

The lid 24 is hinged to the box 12 by means of a pair of hinge elements 226 (FIGS. 5, 14). Each hinge element comprises a first part 228 which is fastened to the rear sides of the box frame 112 and shell 110 by fasteners, such as screws 230, 232, and a second part 234 which is hinged to the first part 228 and is connected to the rear side of the lid shell 32 by fasteners such as screws 236.

Each hinge part 228, 234 is preferably molded of a polymer, such as polycarbonate, the parts being hinged together by a suitable metal pin 238 projecting through aligned holes in the hinge parts.

Each hinge part includes an interior recess 240 which opens to the exterior by means of a passage 242. Anchored within each recess 240 is a foot member 244. Each foot member comprises a pad 246 which projects through the respective passage 242 in order to support the briefcase when the latter is standing upright. Each foot member 244 further comprises a hollow anchoring skirt 248 which is joined to the pad 246. The thickness T of the skirt increases in a direction away from the pad to prevent the skirt from passing through the passage 242. The pad 246 is wedge-shaped at its front end to facilitate travel through said passage 242 and includes lateral shoulders 250 at its rear end which are compressed inwardly during travel of the pad through the passage, and then snap-out behind stop faces 252 of the respective hinge part to prevent the pad from passing back into the passage.

The gripping handle 30 (FIG. 20) is mounted on the front side of the box frame 112 and comprises a hard supporting portion or skeleton 260 and a soft inner portion or grip 262 (FIGS. 20–23). The skeleton 260 is U-shaped, comprising a pair of parallel legs 266 and a bight 268. Preferably, the skeleton 260 is molded of a polymer, such as polycarbonate. The skeleton 260 includes an anchoring strip or flange 270 which projects integrally with the inside surfaces 272, 274 of the legs and bight. The anchoring strip, which is intended to anchor the soft grip 262 to the harder skeleton 260, includes a plurality of elongate holes 276 each bordered by a bead 278, and a plurality of lateral fingers or ribs 280 located between adjacent holes.

The skeleton and grip are preferably each formed of a polymer by means of a conventional two-stage molding operation. That is, after the skeleton 260 has been molded, the soft grip 262 is molded integrally thereto. The grip is also U-shaped, having a bight 282 extending along the inside surface of the bight 268 of the skeleton 260, and a pair of legs 284 extending along the inside surfaces of the legs 266 of the skeleton. The legs of the grip 284 terminate short of the ends of the legs of the skeleton, so as not to cover a pair of mounting holes 288 therein. The inner surface 290 of the grip 262 is grooved to resist slippage of a user's hands while the briefcase is being carried.

The grip 262 of the handle is effectively locked to the skeleton 260 since the material of the former has flowed through the holes 276 in the anchoring strip 270 during the grip-molding step. Locking is also enhanced by the lateral fingers 280 of the skeleton which are embedded in the molded grip 262.

Figures 24, 30, 31:
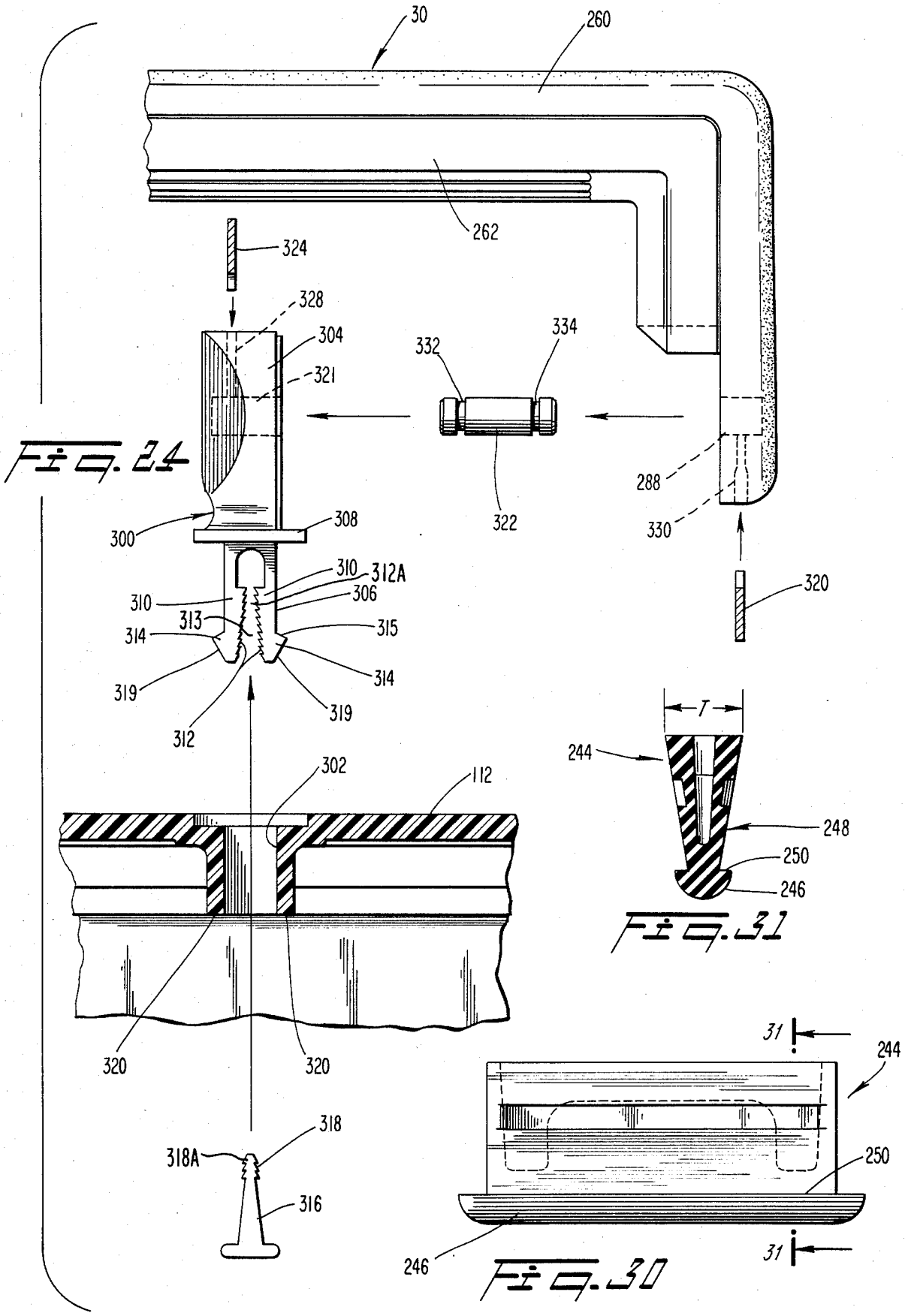
FIG. 24 is an exploded, fragmentary view, depicting a mounting stud which secures the handle to the box member.
FIG. 30 is a side elevational view of a foot member depicted in FIG. 14.
FIG. 31 is a cross-sectional view taken through the foot member along line 31—31 of FIG. 30.

The handle is mounted to the box frame by means of a pair of studs 300 which are secured in holes 302 in the front side of the box frame 112. Each stud is preferably molded of a polymer such as platable ABS, and comprises a handle mount 304 and a bifurcated tongue 306 projecting therefrom (FIG. 24). A lateral flange 308 is situated at the juncture of the handle mount and the tongue. The tongue comprises a pair of legs 310 having teeth 312 in mutually facing relationship. Outwardly projecting lateral feet 314 are disposed at the free ends of the legs. The legs 310 define a space 313 therebetween which gradually widens as it approaches the free ends of the legs.

When the tongue is inserted through the respective hole 302 in the box frame, the legs converge under the influence of front cam surfaces 319, allowing the tongue to be pushed in far enough until the legs spring-out and the flange 308 closes-off the hole. A wedge 316 is then inserted between the legs 310 of the tongue. The wedge, which has teeth 318 of corresponding shape and size to the teeth 312 of the legs, spreads apart the legs 310 such that surfaces 315 of the feet 314 are locked in position behind a pair of shoulders 320 on the box frame, thereby preventing withdrawal of the stud. That is, the peaks 318A of the teeth 318 slide across and between the peaks 312A of the teeth 312 to expand the legs. The surfaces 315 are non-parallel relative to the shoulders 320, whereby spreading of the feet causes the surfaces 315 to act as cam followers and become moved farther into the box. Thus, the flange 388 is pulled tightly against the box frame 112. Accidental removal of the wedge from the tongue is resisted by the one-way orientation of the interlocking teeth, i.e., once inserted, the wedge cannot be withdrawn from the stud.

Each handle mount includes a hole 321 in which is mounted one end of a pin 322. The axle pins are retained by keys which are inserted into the slots of the studs. The other end of the pin 322 is mounted within a hole 288 of the handle. A pair of keys 324, 326 are inserted through slots 328, 330 of the stud and handle and project into respective grooves 332, 334 of the pin, to prevent removal of the latter. The pins 322 are aligned to define an axis of rotation for the handle which is loosely mounted thereon.

The stud and wedge are each preferably molded of a polymer such as a polycarbonate for example.

In order to brace and retain the lid in an open position, the pair of stays 20 are provided. Each stay 20 comprises a pair of mutually hinged links 350, 352 (FIGS. 25–29) which interconnect the lid and box frames 34, 112. The links are preferably formed of metal. An end of one of the links 350 is pivotably connected to a fitting 354 on the lid frame 34 (FIG. 9). An end of the other link is pivotably mounted at 356 to the box frame 112.

The links 350, 352 are pivotably interconnected at their adjoining ends by means of a fastener such as a rivet 358. Interposed between the adjoining ends of the links is a detent washer 360 (FIG. 26) which is preferably formed of a resiliently flexible material such as acetyl or nylon for example. The rivet 358 passes centrally through the detent washer 360 to retain the latter. One side 316 of the washer is generally planar and bears against the first link 352. The other side of the detent washer carries integral projections which are received in holes 362 in a corresponding one of the links 352 to prevent relative rotation between the detent washer 360 and that first link 352 about the axis of the rivet. Also provided on that same side of the detent washer 360 are a pair of recesses 364 (see the broken lines in FIG. 29). Disposed on the other side of the washer opposite the recesses are a pair of detents 366 which project toward a second of the links 350. The second link 350 is provided with a pair of projections 368 which frictionally bear against the detent-carrying side of the washer 360. Each projection is positioned to contact a respective one of the detents 366 as the links rotate relative to one another. The detents are each beveled to define inclined leading and trailing edges 370, 372 which facilitate travel of the projections over the detents. When the lid is in a closed condition, each projection 368 lies to one side of the respective detent 366 (FIG. 28). There occurs relative rotation between the links 350, 352 about the axis of the rivet 358 as the lid is being raised, so the projections 368 eventually contact the detents 366 and travel thereover (FIG. 27). This travel is permitted by the presence of the recesses 364 which enable the detent-carrying sections of the washer to flex toward the first link 352 (FIG. 27). After the projections 368 have passed completely over the detents, the detents 366 rebound to their unflexed positions (FIG. 28). Thus, as viewed in FIG. 29, the projection 368 lies to one side of the respective detent in the lid-raised position. In the lid-closed position, the projection 368 would lie to the opposite side of the detent after passing thereover. A stop lug 374 on the first link 352 is adapted to contact the other link 350 to limit the amount of relative rotation which can occur between the links.

The flexing of the detents 366 to accommodate travel of the projections thereover in either direction requires the application of additional force by the user. Thus, the stay links are held in the lid-raised condition until sufficient forces are applied to flex the detents and close the lid.

A pair of decorative caps 380 can be mounted on the adjoining ends of the stay links to cover the rivet.

It will be appreciated that the luggage construction according to the present invention is novel and advantageous. The unique cooperative structural relationship between the hasp and post elements assures that the lid will be "popped-open" in response to unlatching of the lid, thereby avoiding the need for separate springs to achieve this function. This action is accomplished by the configuration of the post which spreads apart the legs of the hasp and then permits the legs to rebound while sliding along a convergent portion of the post. Also, any attempt to raise the lid when the hasp is still closed, causes the legs of the hasp to be drawn together, due to the shape of the post.

The unique stay assembly virtually eliminates metal-to-metal rubbing and the accompanying high amounts of frictional wear. Hence, the useful life of the stay is extended.

The handle is uniquely formed by a two-stage molding process, and the stiff handle part effectively retains the soft gripping part by means of an embedded flange having locking ribs and recesses.

The handle is securely mounted by means of a fastener which involves merely sliding a wedge into a bifurcated stud to expand a pair of legs of the stud while interlocking with teeth thereof. The shape of the feet of the legs assures that the stud will be pulled tightly against the frame.

The hinge element contains a support foot which is effectively held within the hinge by means of an anchoring skirt. This enables the foot to be easily inserted by a manual press-fit, while avoiding accidental dislodgement of the foot from the hinge.

Although the present invention has been described in connection with a preferred embodiment thereof, it will be appreciated by those skilled in the art that additions, modifications, substitutions, and deletions, not specifically described may be made, without departing from the spirit and scope of the invention as defined in the appended claims.

What is claimed is:

1. In a container of the type comprising a box member, a lid member hinged thereto, and at least one stay assembly interconnecting said members to retain said lid member in an open position, the improvement wherein said stay assembly comprises first and second links interconnected at mutually adjoining ends for rotation about an axis, another end of said first link being rotatably connected to one of said members, and another end of said second link being rotatably connected to the other of said members, said links being relatively rotatable about said axis between lid-open and lid-closed positions, a resiliently flexible non-metallic washer interposed between said adjoining ends of said links such that said axis passes through said washer, said washer being disc-shaped and including a generally planar first side bearing against said adjoining end of said first link and a second, opposite side facing said adjoining end of said second link, means preventing relative rotation between said washer and said first link, while relative rotation between said washer and said second link is permitted, said first side of said washer including at least one recess which renders an overlying section of said second surface to be resiliently flexible away from the plane of said adjoining end of said second link, a shoulder formed on said section of said second surface and projecting toward said second link, a projection disposed on said adjoining end of said second link and directed toward said washer so as to flex said resiliently flexible section away from said plane and into said recess in response to relative rotation between said lid and box members to a lid-open position until said projection travels beyond said shoulder enabling the latter to rebound toward said plane, whereby said shoulder yieldably resists reverse travel of said projection.

2. Apparatus according to claim 1, wherein said shoulder has an inclined edge over which said projection travels.

3. In luggage of the type comprising a box member, a lid member, a swiveling handle, and a mounting means mounting said handle to one of said members, the improvement wherein said mounting means comprises:

a pair of studs defining a swiveling axis for said handle, each stud including a flange and a pair of legs projecting from said flange and each terminating in a free end, said legs defining a space therebetween which gradually widens as it approaches said free ends of said legs, each leg having a plurality of first teeth projecting inwardly toward corresponding first teeth of the other leg such that said first teeth are disposed on opposite sides of said space, said first teeth forming first peaks at the ends thereof, said free ends of said legs having outwardly projecting feet, said legs being insertable from the exterior through an opening of said one member such that said feet are situated beyond respective shoulders of said one member, and a wedge-shaped member having opposite sides each including outwardly projecting second teeth, said second teeth forming second peaks at the ends thereof, said wedge being inserted longitudinally from the interior into said space between said legs such that said second peaks of said second teeth slide across and between said first peaks of said first teeth in a longitudinal direction to spread said legs apart such that said feet are locked in position behind said shoulders, said first and second teeth becoming interlocked in said space at a location between said feet and said flange to prevent separation of said wedge from said stud.

4. Apparatus according to claim 3, wherein said feet include surfaces disposed non-parallel relative to said shoulders and in engagement therewith such that said stub is drawn tightly against said one member as said legs are spread apart.

* * * * *